US011090897B2

(12) United States Patent
Totani

(10) Patent No.: US 11,090,897 B2
(45) Date of Patent: Aug. 17, 2021

(54) BAG MAKING MACHINE AND METHOD FOR MAKING PLASTIC BAG

(71) Applicant: Totani Corporation, Kyoto (JP)

(72) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 189 days.

(21) Appl. No.: 16/317,027

(22) PCT Filed: Jul. 12, 2017

(86) PCT No.: PCT/JP2017/025427
§ 371 (c)(1),
(2) Date: Jan. 10, 2019

(87) PCT Pub. No.: WO2018/012542
PCT Pub. Date: Jan. 18, 2018

(65) Prior Publication Data

US 2019/0308384 A1 Oct. 10, 2019

(30) Foreign Application Priority Data

Jul. 14, 2016 (JP) ..... JP2016-139635

(51) Int. Cl.
*B31B 70/84* (2017.01)
*B31B 70/64* (2017.01)
(Continued)

(52) U.S. Cl.
CPC ..... *B31B 70/844* (2017.08); *B31B 70/04* (2017.08); *B31B 70/10* (2017.08); *B31B 70/16* (2017.08);
(Continued)

(58) Field of Classification Search
CPC ..... B31B 70/26; B31B 70/266; B31B 70/64; B31B 70/642; B31B 70/644;
(Continued)

(56) References Cited

U.S. PATENT DOCUMENTS 6,481,183 B1 * 11/2002 Schmidt ..... B65B 9/20 383/63
2004/0258332 A1 * 12/2004 Totani ..... B65D 31/10 383/120
(Continued)

FOREIGN PATENT DOCUMENTS

CN 103415445 11/2013
CN 104057642 9/2014
(Continued)

OTHER PUBLICATIONS

"Search Report of Europe Counterpart Application", dated May 22, 2019, p. 1-p. 9.
(Continued)

*Primary Examiner* — Hemant Desai
*Assistant Examiner* — Christopher Robin Kim
(74) *Attorney, Agent, or Firm* — JCIPRNET

(57) ABSTRACT

A web of first or second material is provided with the spout, and a plastic bag is made from side gusset materials in addition to webs of the first and second materials. An aperture is formed in the web of the first or second panel material, and the spout is inserted into and positioned with the aperture, whenever the webs of the first and second panel materials are fed intermittently. After the webs of the first and second panel materials are superposed on each other, whenever the webs of the first and second panel materials are fed intermittently, the webs of the first and second panel materials are heat sealed with each other in a longitudinal direction thereof by a longitudinal seal device, and the webs of the first and second panel materials are heat sealed with the side gusset materials in a width direction thereof by a cross seal device.

4 Claims, 12 Drawing Sheets

(51) Int. Cl.

| | |
|---|---|
| ***B31B 70/04*** | (2017.01) |
| ***B31B 70/81*** | (2017.01) |
| ***B31B 70/86*** | (2017.01) |
| ***B31B 70/10*** | (2017.01) |
| ***B31B 70/16*** | (2017.01) |
| ***B31B 70/26*** | (2017.01) |
| *B31B 155/00* | (2017.01) |
| *B31B 160/20* | (2017.01) |
| *B65D 33/08* | (2006.01) |
| *B31B 170/10* | (2017.01) |

(52) U.S. Cl.
CPC ..... *B31B 70/266* (2017.08); *B31B 70/64* (2017.08); *B31B 70/642* (2017.08); *B31B 70/644* (2017.08); *B31B 70/645* (2017.08); *B31B 70/8123* (2017.08); *B31B 70/84* (2017.08); *B31B 70/872* (2017.08); *B31B 2155/001* (2017.08); *B31B 2155/002* (2017.08); *B31B 2160/20* (2017.08); *B31B 2170/10* (2017.08); *B65D 33/08* (2013.01)

(58) Field of Classification Search
CPC . B31B 70/645; B31B 70/813; B31B 70/8131; B31B 70/8132; B31B 70/8133; B31B 70/84; B31B 70/85; B31B 2170/00
USPC ..... 493/186, 189, 197, 203, 210, 212, 214
See application file for complete search history.

(56) References Cited

U.S. PATENT DOCUMENTS

| | | | | |
|---|---|---|---|---|
| 2005/0272583 | A1* | 12/2005 | Totani | B31B 70/00 493/162 |
| 2010/0142859 | A1* | 6/2010 | Cushman | A47J 43/27 383/10 |
| 2011/0015052 | A1 | 1/2011 | Totani | |
| 2011/0039676 | A1* | 2/2011 | Totani | B31B 70/262 493/227 |
| 2012/0035035 | A1* | 2/2012 | Totani | B31B 37/00 493/193 |
| 2012/0195528 | A1* | 8/2012 | Font Lletche | B65D 75/566 383/42 |
| 2012/0231941 | A1* | 9/2012 | Senbo | B31B 50/00 493/189 |
| 2013/0279832 | A1* | 10/2013 | Burri | B65D 75/5827 383/205 |
| 2013/0281964 | A1* | 10/2013 | Kugelmann | A61M 1/1668 604/410 |
| 2015/0005148 | A1* | 1/2015 | Ohmae | B65D 75/008 493/194 |
| 2015/0274392 | A1* | 10/2015 | Pease | B65D 75/008 383/10 |
| 2016/0129628 | A1* | 5/2016 | Nagata | B31B 70/64 493/200 |
| 2016/0176579 | A1* | 6/2016 | Brauer | B65D 29/00 383/10 |

FOREIGN PATENT DOCUMENTS

| | | |
|---|---|---|
| EP | 0052151 | 5/1982 |
| JP | H043950 | 1/1992 |
| JP | H11100050 | 4/1999 |
| JP | 2006341876 | 12/2006 |
| JP | 4526592 | 8/2010 |
| JP | 2011067997 | 4/2011 |
| JP | 2013500890 | 1/2013 |
| JP | 2013159093 | 8/2013 |
| JP | 5913695 | 4/2016 |
| WO | 2015171171 | 11/2015 |

OTHER PUBLICATIONS

"International Search Report (Form PCT/ISA/210)" of PCT/JP2017/025427, dated Aug. 22, 2017, with English translation thereof, pp. 1-4.
"Office Action of Australia Counterpart Application," dated Aug. 22, 2019, p. 1-p. 4.
Office Action of Canada Counterpart Application, dated Nov. 20, 2019, p. 1-p. 4.

* cited by examiner

BAG MAKING MACHINE AND METHOD FOR MAKING PLASTIC BAG

CROSS-REFERENCE TO RELATED APPLICATION

This application is a 371 application of the international PCT application serial no. PCT/JP2017/025427, filed on Jul. 12, 2017, which claims the priority benefits of Japan application no. 2016-139635, filed on Jul. 14, 2016. The entirety of each of the abovementioned patent applications is hereby incorporated by reference herein and made a part of this specification.

TECHNICAL FIELD OF THE INVENTION

The invention relates to a bag making machine for making plastic bags and a manufacturing method of the same.

BACKGROUND OF THE INVENTION

In a bag making machine for making plastic bags, as described in Patent Document 1, webs of first and second panel materials are superposed on each other to be fed longitudinally thereof and intermittently. Furthermore, as also in the case of the bag making machine of Patent Document 1, the side gusset materials are supplied to the web of the first or second material whenever being fed intermittently and before being superposed on each other. The side gusset materials are extended widthwise of the web, and disposed between the webs of the first and second panel materials when the webs of the first and second panel materials are superposed on each other. Then, the webs of the first and second panel materials are heat sealed with each other longitudinally thereof by a longitudinal seal device and widthwise thereof by a cross seal device whenever being fed intermittently. As a result, the plastic bags are made from the first and second panel materials and the side gusset materials.

In the case of the plastic bag, it is clear that the side gusset materials can lead to an increase in the capacity of the plastic bag. On the other hand, as shown in Patent Documents 2 and 3, the other plastic bags are often provided with a spout in a proper place. The spout is used in order to discharge the content with which the plastic bag is filled. Therefore, in case that the plastic bag is made from the side gusset materials in addition to the first and second materials when the first or second material is provided with the spout, the content of the capacious plastic bag can be discharged through the spout. The plastic bags have various uses and a high degree of usability. It is therefore desired to improve the bag making machine and the method for making plastic bags.

It is therefore an object of the invention to provide the bag making machine and the method for making plastic bags each of which includes the side gusset materials in addition to the first and second panel materials, in which the first or second panel material is provided with the spout.

CITED REFERENCES

Patent Literature

Patent Document 1: JP 4,526,592 B
Patent Document 2: JP 2013-159093 A

Patent Document 2: JP 5,913,695 B

SUMMARY

According to the invention, a bag making machine comprises: a panel material feed device, by which webs of a first panel material and a second panel material are superposed on each other, and fed in a longitudinal direction of the webs of the first panel material and the second panel material intermittently; a side gusset material supply device, by which side gusset materials are supplied to the web of the first panel material or the web of the second panel material, so as to be extended in a width direction of the webs of the first panel material and the second panel material, whenever the webs of the first panel material and the second panel material are fed intermittently before the webs of the first panel material and the second panel material are superposed on each other, the side gusset materials being disposed between the webs of the first panel material and the second panel material when the webs of the first panel material and the second panel material are superposed on each other; a spout mounting device, by which an aperture is formed in the web of the first panel material or the web of the second panel material, and a spout is inserted into and positioned with the aperture, whenever the webs of the first panel material and the second panel materials are fed intermittently before the webs of the first panel material and the second panel material are superposed on each other; a longitudinal seal device, by which the webs of the first panel material and the second panel material are heat sealed with each other in the longitudinal direction of the webs of the first panel material and the second panel material, whenever the webs of the first panel material and the second panel material are fed intermittently after the webs of the first panel material and the second panel material are superposed on each other; and a cross seal device, by which the webs of the first panel material and the second panel material are heat sealed with the side gusset materials in the width direction of the webs of the first panel material and the second panel material, whenever the webs of the first panel material and the second panel material are fed intermittently after the webs of the first panel material and the second panel material are superposed on each other. The web of the first panel material or the web of the second material is provided with the spout, and a plastic bag is made from the side gusset materials in addition to the webs of the first panel material and the second panel material.

Moreover, according to the invention, a method for making a plastic bag comprises: feeding webs of a first panel material and a second panel material in a longitudinal direction intermittently, and superposing the webs of the first panel material and the second panel material on each other; supplying side gusset materials to the web of the first panel material or the web of the second panel material, and extending the side gusset materials in a width direction of the webs of the first panel material and the second panel material, whenever the webs of the first panel material and the second panel material are fed intermittently before the webs of the first panel material and the second panel material are superposed on each other, so that the side gusset materials are disposed between the webs of the first panel material and the second panel material when the webs of the first panel material and the second panel material are superposed on each other; forming an aperture in the web of the first panel material or the web of the second panel material, so that a spout is inserted into and positioned with the aperture, whenever the webs of the first panel material and the second panel material are fed intermittently before the webs of the first panel material and the second panel material are superposed on each other; heat sealing the webs of the first panel material and the second panel material with each other in the longitudinal direction of the webs of the first panel material and the second panel material, whenever the webs of the first panel material and the second panel material are fed intermittently after the webs of the first panel material and the second panel material are superposed on each other; and heat sealing the webs of the first panel material and the second panel material with the side gusset materials in the width direction of the webs of the first panel material and the second panel material, whenever the webs of the first panel material and the second panel material are fed intermittently after the webs of the first panel material and the second panel material are superposed on each other; whereby, the web of the first panel material or the web of the second panel material is provided with the spout, and the plastic bag is made from the side gusset materials in addition to the webs of the first panel material and the second panel material.

In a preferred embodiment, the side gusset materials in addition to the webs of the first panel material and the second panel material are cross cut in the width direction of the webs of the first panel material and the second panel material, whenever the webs of the first panel material and the second panel material are fed intermittently after being heat sealed.

In a preferred embodiment, each of the webs of the first panel material and the second panel material includes a side edge. The webs of the first panel material and the second panel material are heat sealed with each other by a longitudinal seal device, so as to form a longitudinal sealed portion along the side edge. The webs of the first and second panel materials are heat sealed with the side gusset materials by a cross seal device, so as to form cross sealed portions. The webs of the first and second panel materials are obliquely heat sealed with the side gusset materials at a position adjacent to the longitudinal sealed portion, so as to form oblique sealed portions. The longitudinal sealed portion and the cross sealed portions are connected to each other by the oblique sealed portions. The side gusset materials in addition to the webs of the first panel material and the second panel material are bonded with each other by the oblique sealed portions at a position adjacent to the longitudinal sealed portion, so that oblique surfaces are formed on the webs of the first panel material and the second panel material respectively, when the plastic bag being manufactured and being filled with a content. Among the oblique surfaces, one of the oblique surfaces is provided with the spout.

In a preferred embodiment, the longitudinal sealed portion has a predetermined width. A through portion is formed in the longitudinal sealed portion and between each of the cross sealed portions. A first handle is made from the longitudinal sealed portion and the through portion.

In a preferred embodiment, the longitudinal sealed portion has a predetermined width. A through portion is formed in the longitudinal sealed portion and between each of the cross sealed portions. The through portion includes a pair of oblique through portions extended along the oblique sealed portions at the opposite side portions of the through portion. A first handle is made from the longitudinal sealed portion and the through portion.

In a preferred embodiment, the webs of the first panel material and the second panel material are guided while the webs of the first panel material and the second panel material are fed. The web of the first panel material includes an additional side edge. The web of the second panel material includes a corresponding additional side edge. The web of the first panel material is folded at a position adjacent to the additional side edge and along a first folded line. The web of the second panel material is folded at a position adjacent to the corresponding additional side edge and along a second folded line. Whereby, a first folded portion is formed on the web of the first panel material, and a second folded portion is formed on the web of the second panel material. Then, the first folded portion is superposed on the second folded portion, and the additional side edge being aligned with the corresponding additional side edge. The plastic bag is made from the webs of the first panel material and the second panel material, and an end surface is formed by the first folded portion.

In a preferred embodiment, when the webs of the first panel material and the second panel material are folded along the first folded line and the second folded line, the additional side edge is apart from the first folded line at a distance L1, the corresponding additional side edge is apart from the second folded line at a distance L2. The distance L1 between the additional side edge and the first folded line is longer than twice the distance L2 between the corresponding additional side edge and the second folded line by a predetermined distance L3. A protruding portion is formed by the predetermined distance L3. A through portion is formed in the protruding portion. A second handle is made from the protruding portion and the through portion.

In a preferred embodiment, the webs of the first panel material and the second panel material are guided while the webs of the first panel material and the second panel material are fed. The web of the first panel material includes a side edge. The web of the second panel material includes a corresponding side edge. The web of the first panel material is folded at a position adjacent to the side edge and along a first folded line. The web of the second panel material is folded at a position adjacent to the corresponding side edge and along a second folded line. Whereby, a first folded portion is formed on the web of the first panel material, and a second folded portion is formed on the web of the second panel material. Then, the first folded portion is superposed on the second folded portion, and the side edge is aligned with the corresponding side edge. The plastic bag is made from the webs of the first panel material and the second panel material, an end surface is formed by the first folded portion, and the end surface is provided with the spout.

In a preferred embodiment, when the webs of the first panel material and the second panel material are folded along the first folded line and the second folded line, the side edge is apart from the first folded line at a distance L1, and the corresponding side edge is apart from the second folded line at a distance L2. The distance L1 between the side edge and the first folded line is longer than twice the distance L2 between the corresponding side edge and the second folded line by a predetermined distance L3. A protruding portion is formed by the predetermined distance L3. A through portion is formed in the protruding portion. A second handle is made from the protruding portion and the through portion.

In a preferred embodiment, each of the first folded portion and the second folded portion has an extra width. An extra portion is formed by the extra width. A through portion is formed in the extra portion. A third handle is made from the extra portion and the through portion.

In a preferred embodiment, the webs of the first panel material and the second panel material are guided by the panel material guide device. The web of the first panel material includes an additional side edge. The web of the second panel material includes a corresponding additional side edge. The web of the first panel material is folded at a position adjacent to the additional side edge and along a third folded line. The web of the second panel material is folded at a position adjacent to the corresponding additional side edge and along a fourth folded line. Whereby, a third folded portion is formed on the web of the first panel material, and a fourth folded portion is formed on the web of the second panel material. Then, the third folded portion is superposed on the fourth folded portion, and the additional side edge is aligned with the corresponding additional side edge. An additional end surface is formed by the third folded portion.

In a preferred embodiment, when the webs of the first panel material and the second panel material are folded along the third folded line and the fourth folded line, the additional side edge is apart from the third folded line at a distance L1, and the corresponding additional side edge is apart from the fourth folded line at a distance L2. The distance L1 between the additional side edge and the third folded line is longer than twice the distance L2 between the corresponding additional side edge and the fourth folded line by a predetermined distance L3. A protruding portion is formed by the predetermined distance L3. A through portion is formed in the protruding portion. A second handle is made from the protruding portion and the through portion.

In a preferred embodiment, each of the third folded portion and the fourth folded portion has an extra width. An extra portion is formed by the extra width. A through portion is formed in the extra portion. A third handle is made from the extra portion and the through portion.

In a preferred embodiment, the plastic bag provided with a plurality of handles is made.

EXPLANATION OF THE PREFERRED EMBODIMENTS

Embodiments of the invention are described as follows.

First Embodiment

FIG. 1A and FIG. 1B and FIG. 2A and FIG. 2B illustrate a bag making machine according to the invention. The bag making machine is used in order to make a plastic bag shown in FIG. 3A to FIG. 3C. A longitudinal direction X, a width direction Y and a vertical direction Z are right angle to each other. The plastic bag in FIG. 3A to FIG. 3C includes a first panel material 1, a second panel material 2, side gusset materials 3 and a spout 4.

Figure 1A:
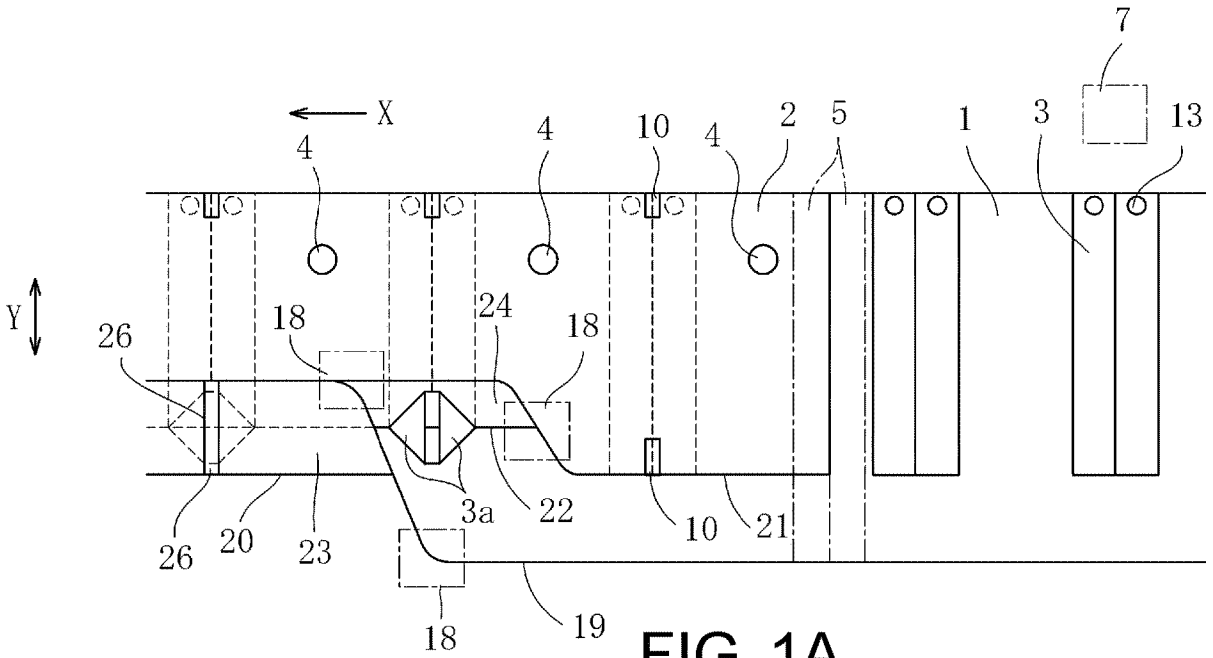
FIG. 1A is a plan view of an embodiment of the invention.
Figure 1B:
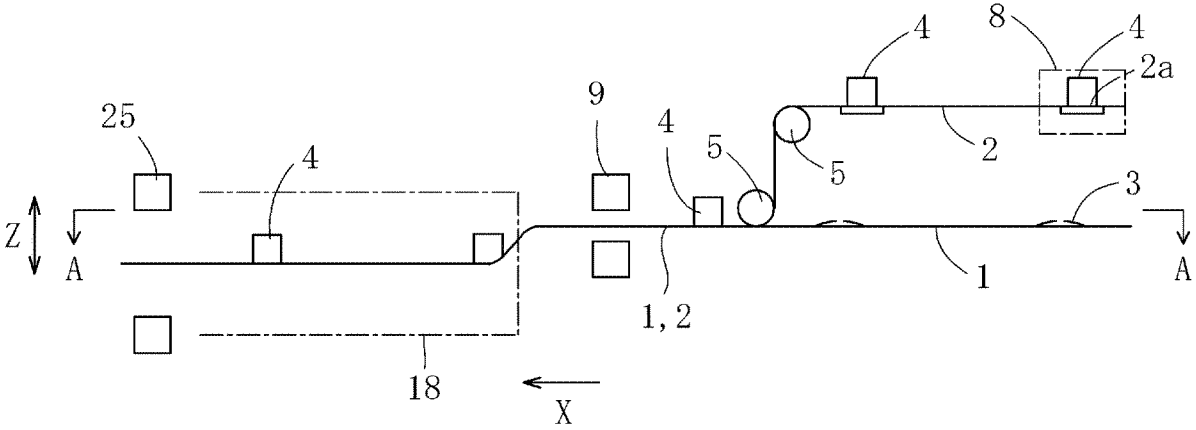
FIG. 1B is a side view of a bag making machine shown in FIG. 1A.
Figure 2A:
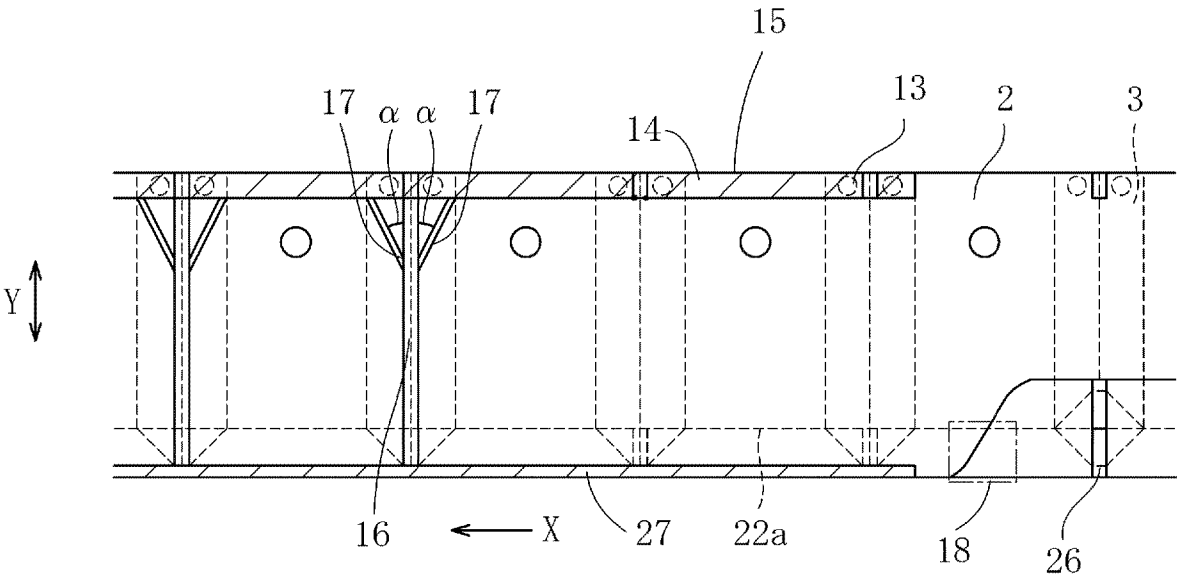
FIG. 2A is a plan view showing side gusset materials in addition to webs of first and second panel materials of FIG. 1A and FIG. 1B when being heat sealed and observed from A-A direction of FIG. 1B.
Figure 2B:
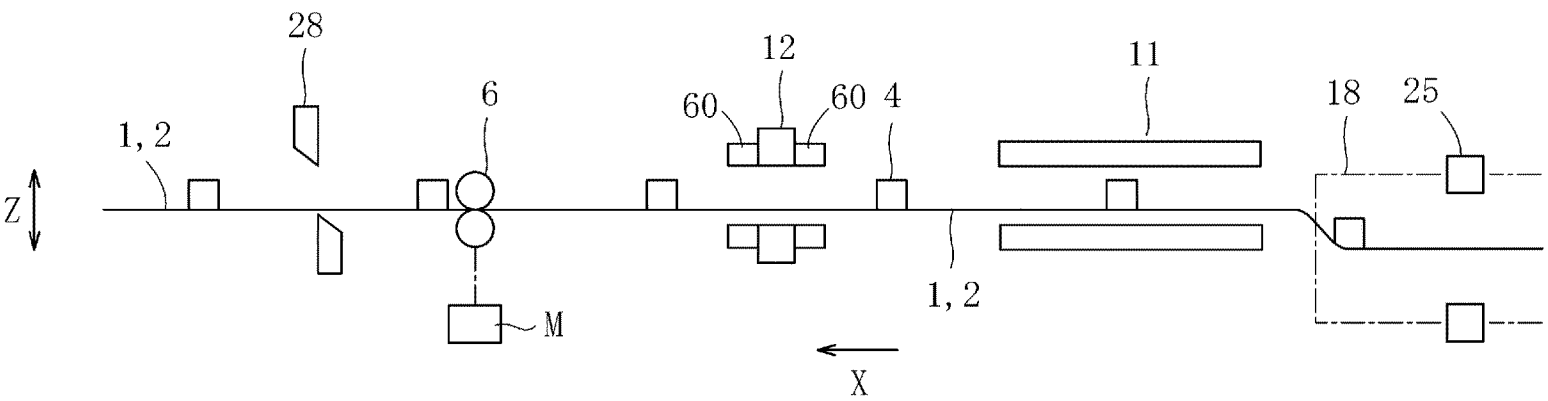
FIG. 2B is a side view of the bag making machine shown in FIG. 2A.
Figure 3A:
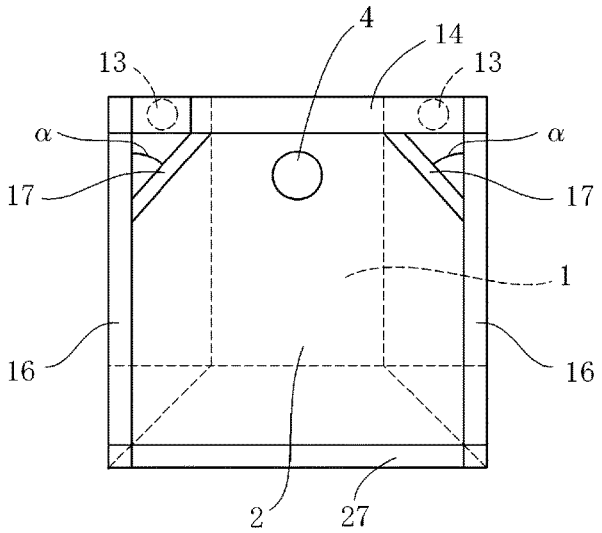
FIG. 3A is a plan view showing a plastic bag made by the bag making machine shown in FIG. 1A and FIG. 1B.
Figure 3B:
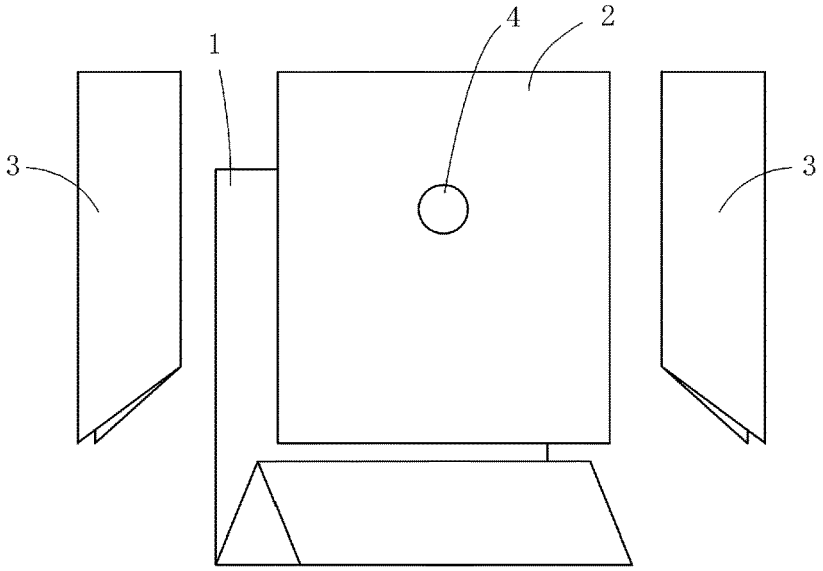
FIG. 3B is an explosive view showing the plastic bag shown in FIG. 3A.
Figure 3C:
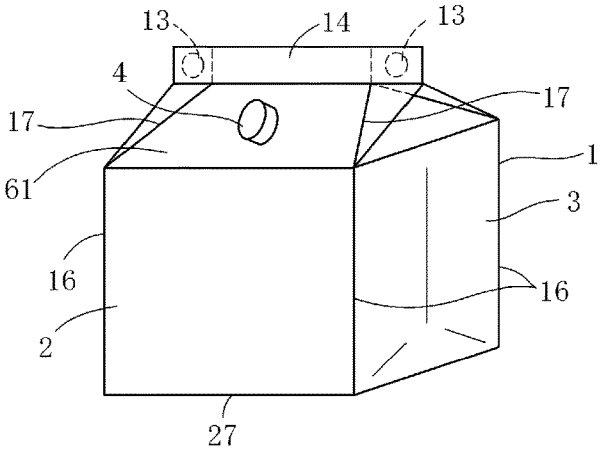
FIG. 3C is a perspective view showing the plastic bag in FIG. 3A which is filled with content.

In order to make the plastic bag shown in FIG. 3A to FIG. 3C, the bag making machine shown in FIG. 1A and FIG. 1B and FIG. 2A and FIG. 2B comprises a panel material feed device by which webs of the first and second panel materials 1 and 2 are superposed on each other so as to be fed in the longitudinal direction X intermittently. For example, the webs of the first and second panel materials 1 and 2 are opposed to each other in vertical direction Z so as to be intermittently fed in a horizontal direction. A feed direction X is the longitudinal direction X of the webs of the first and second panel materials 1 and 2. The webs of the first and second panel materials 1 and 2 are guided to guide rollers 5 so as to be superposed on each other. Thus, the web of the first panel material 1 is a web of a panel material disposed on a lower side, while the web of the second panel material 2 is a web of a panel material disposed on an upper side. Moreover, as shown in FIG. 2A and FIG. 2B, the feed rollers 6 is used in the panel material feed device, and after the webs of the first and second panel materials 1 and 2 are superposed, the superposed webs of the first and second panel materials 1 and 2 are guided to the feed rollers 6. The feed rollers 6 are rotated by a driving motor M so as to feed the webs of the first and second panel materials 1 and 2 in the longitudinal direction X intermittently. The webs of the first and second panel materials 1 and 2 are made from plastic film.

Moreover, in the bag making machine, before the webs of the first and second panel materials 1 and 2 are superposed on each other, the side gusset materials 3 are supplied to be extended in the width direction Y of the webs whenever the webs of the first and second panel materials 1 and 2 are fed intermittently. Then, the side gusset materials 3 are disposed between the webs of the first and second panel materials 1 and 2, when the webs of the first and second panel materials 1 and 2 are superposed on each other. In this embodiment, the side gusset materials 3 are supplied to the web of the first panel material 1 disposed on the lower side so as to be mounted on the upper surface thereof. The side gusset materials 3 are extended in the width direction Y of the web of the first panel material 1 disposed on the lower side. Thus, the side gusset materials 3 are disposed between the webs of the first and second panel materials 1 and 2, when the webs of the first and second panel materials 1 and 2 are superposed on each other. The side gusset materials 3 are also made from plastic film. Thus, a side gusset material supply device 7 is provided by which the side gusset materials 3 are supplied. The side gusset material supply device 7 is the same as that of Patent Document 1.

Before the webs of the first and second panel materials 1 and 2 are superposed on each other, an aperture 2*a* is formed in the web of the first or second panel material 1 or 2, whenever the webs of the first and second panel materials 1 and 2 are fed intermittently. The spout 4 is positioned with and inserted into the aperture 2*a*. For example, the aperture 2*a* is formed in the web of the second panel material 2 disposed on the upper side, so that the spout 4 can be positioned with and inserted into the aperture 2*a*. The spout 4 is made of plastic. Thus, a spout mounting device 8 is provided by which the aperture 2*a* is formed and the spout 4 is positioned with and inserted into the aperture 2*a*. The spout mounting device 8 is the same as that of Patent Documents 2 and 3, to relate to a heat seal type. Thus, by using the spout mounting device 8, the spout 4 is heat sealed with the web of the second panel material 2 and the spout 4 is mounted.

When the spout 4 is mounted, as described in Patent Document 3, it is preferable that the aperture 2*a* is formed and the spout 4 is inserted and mounted into the aperture 2*a* at the same place. However, as described in Patent Document 2, the aperture 2*a* can be formed and the spout 4 can be inserted and mounted into the aperture 2*a* at different places.

Then, the web of the second panel material 2 and the spout 4 are guided to the guide rollers 5. For example, the guide rollers 5 are divided widthwise of the web of the first or second panel material 1 or 2 at an interval through which the spout 4 can be passed. The guide roller 5 may have a reduced diameter in such a manner that the diameter of the guide roller is reduced partially. The spout 4 can be passed through the reduced diameter. The feed rollers 6 may be the same as the guide rollers 5 in structure.

The side gusset material 3 is previously folded into halves on the opposite sides of the centerline of the longitudinal direction (the width direction Y) thereof to be superposed into two layers when being supplied by the side gusset material supply device 7, as in the case of the bag making machine of Patent Document 1. As a result, the side gusset material 3 is formed as a flattened pipe. Thus, a temporality seal device 9 is provided by which the web of the first panel material 1 and the side gusset material 3 are heat sealed or ultrasonic sealed with each other, and the web of the second panel material 2 and the side gusset material 3 are heat sealed or ultrasonic sealed with each other, after the webs of the first and second panel materials 1 and 2 are superposed with each other. Thus, the side gusset material 3 in addition to the webs of the first and second panel materials 1 and 2 are temporality attached to each other at places where temporality sealed portions 10 are formed. The temporality sealed portions 10 are disposed on the centerline of the longitudinal direction (the width direction Y) of the side gusset material 3.

Moreover, a longitudinal seal device 11 is provided by which the webs of the first and second panel materials 1 and 2 are heat sealed with each other in the longitudinal direction X thereof, whenever the webs of the first and second panel materials 1 and 2 are fed intermittently. Besides, a cross seal device 12 is provided by which the webs of the first and second panel materials 1 and 2 are heat sealed with the side gusset material 3 in the width direction Y thereof, whenever the webs of the first and second panel materials 1 and 2 are fed intermittently. Moreover, in the bag making machine, as above described, the side gusset material 3 is previously folded into halves on the opposite sides of the centerline of the longitudinal direction (the width direction Y) thereof to be superposed into two layers, when being supplied by the side gusset material supply device 7. The side gusset material supply device 7 comprises a punching device (not shown) by which the side gusset material 3 is punched so as to form apertures 13 at one end portion of the side gusset material 3 after folded into halves. Therefore, the webs of the first and second panel materials 1 and 2 are heat sealed with each other at the position of aperture 13 by the longitudinal seal device 11.

Moreover, in the bag making machine, each of the webs of the first and second panel materials 1 and 2 includes a side edge 15. The webs of the first and second panel materials 1 and 2 are heat sealed with each other by the longitudinal seal device 11 so that longitudinal sealed portions 14 are formed along the side edges 15 thereof. The webs of the first and second panel materials 1 and 2 are heat sealed with the side gusset materials 3 by the cross seal device 12 so that cross sealed portions 16 are formed in the width direction Y thereof. The longitudinal sealed portion 14 and the cross sealed portion 16 are connected to each other at a right angle. Moreover, the web of the first panel material 1 is obliquely heat sealed with the side gusset material 3 at positions adjacent to the longitudinal sealed portion 14, so as to form oblique sealed portions 17 by which the longitudinal sealed portion 14 and the cross sealed portion 16 are connected to each other. The oblique sealed portion 17 is oblique to the cross sealed portion 16 (the width direction Y) at a predetermined angle α (see FIG. 2A). The predetermined angle α is, for example, 10 to 50 degrees. Each of the oblique sealed portions 17 is symmetry to each of the cross sealed portions 16. For example, in the cross sealed device 12, the heaters 60 are pressed against the webs of the first and second panel materials 1 and 2 and the side gusset materials 3, and the webs of the first and second panel materials 1 and 2 and the side gusset materials 3 are heat sealed with each other. Each of the heater 60 comprises an oblique portion by which the oblique sealed portion 17 is formed so that the longitudinal sealed portion 14 and the cross sealed portion 16 are connected to each other. The oblique seal device (i.e., the heater 60) may be apart from both the longitudinal seal device 11 and the cross seal device 12 so as to form the longitudinal sealed portion 14, the cross sealed portion 16 and the oblique sealed portion 17 at different places from each other.

Moreover, the web of the first panel material 1 includes an additional side edge 19. The web of the second panel material 2 includes a corresponding additional side edge 21. The bag making machine comprises a panel material guide device 18 by which the webs of the first and second panel materials 1 and 2 are guided, while the webs of the first and second panel materials 1 and 2 are fed. The web of the first panel material 1 is folded at a position adjacent to the additional side edge 19 and along a first folded line 20 extended in the longitudinal direction X and by the panel material guide device 18, while the web of the second panel material 2 is folded at a position adjacent to the corresponding additional side edge 21 and along a second folded line 22 extended in the longitudinal direction X and by the panel material guide device 18. Thus, a first folded portion 23 is formed on the web of the first panel material 1, while a second folded portion 24 is formed on the web of the second panel material 2. Moreover, the first folded portion 23 is superposed on the second folded portion 24, and the additional side edge 19 is aligned with the corresponding additional side edge 21. The panel material guide device 18 is the same as that of Patent Document 1 comprising guide rollers and plates.

Thus, as in the case of the bag making machine of Patent Document 1, the side gusset material 3 can be opened so as to make an open surface 3*a* when the web of the second panel material 2 is folded along the second folded line 22. Then, the web of the first panel material 1 is folded along the first folded line 20 so as to be superposed on the open surface 3*a*. Moreover, an open surface seal device 25 is provided by which the web of the first panel material 1 and the side gusset material 3 are heat sealed with each other at the positon of the open surface 3*a* so as to make an open surface sealed portion 26, whenever the webs of the first and second panel materials 1 and 2 are fed intermittently. The open surface sealed portion 26 is disposed on the centerline of the longitudinal direction (the width direction Y) of the side gusset material 3. And then, the web of the second panel material 2 is folded back to the original state, and in the first folded portion 23, the web of the first panel material 1 is folded back along the folded back line 22*a*. The folded back line 22*a* is disposed on the second folded line 22. As a result, the side gusset material 3 (the open surface 3*a*) is closed, so as to form an auxiliary gusset portion on the side gusset material 3.

And then, the webs of the first and second panel materials 1 and 2 are heat sealed with each other by the longitudinal seal device 11, so as to form a longitudinal sealed portion 27 in addition to the longitudinal sealed portion 14 at the same time. The longitudinal sealed portion 27 is formed along the additional side edge 19 of the web of the first panel material 1 and the corresponding additional side edge 21 of the web of the second panel material 2.

And then, a cutter 28 is provided by which the side gusset material 3 in addition to the webs of the first and second panel materials 1 and 2 are cross cut in the width direction Y of the webs of the first and second panel materials 1 and 2, whenever the webs of the first and second panel materials 1 and 2 are fed intermittently. They are cross cut along each of the centerlines of the longitudinal direction (the width direction Y) of the side gusset materials 3 or the centerlines of the longitudinal direction (the width direction Y) of the cross sealed portions 16.

Therefore, the plastic bags are made. In this bag making machine, the web of the first or second panel material 1 or 2 is provided with the spout 4. The plastic bag is made from the side gusset materials 3 in addition to the webs of the first and second panel materials 1 and 2.

And then, after the plastic bag is manufactured, the content is filled in the plastic bag. For example, the content is filled through the spout 4. When the plastic bag is manufactured, the webs of the first and second panel materials 1 and 2 are not heat sealed with each other along the side edges 15 thereof, but after the manufacture of the plastic bag, the content can be filled through the side edges 15. Thereafter, the webs of the first and second panel materials 1 and 2 are heat sealed with each other along the side edges 15 thereof.

In the case of the plastic bag, the capacity thereof can be increased by the side gusset materials 3. Besides, the spout 4 is used for discharging the filled content. In case of the capacious plastic bag, the content can be discharged through the spout 4. The plastic bag can be used for various purposes and excellent in usability.

Moreover, the plastic bag includes the longitudinal sealed portion 14 and the cross sealed portions 16 which are continuous via the oblique sealed portions 17. Therefore, when the content is filled after the manufacture of the plastic bag, as shown in FIG. 3A to FIG. 3C, the side gusset materials 3 in addition to the webs of the first and second panel materials 1 and 2 are bonded or connected to each other by a pair of the oblique sealed portions 17 at a position adjacent to the longitudinal sealed portion 14, so that oblique surfaces 61 are formed on the webs of the first and second panel materials 1 and 2. The oblique surfaces 61 are oblique to the webs of first and second panel materials 1 and 2. Each of the oblique sealed portions 17 is oblique to the cross sealed portion 16 at the predetermined angle α (FIG. 3A). The oblique sealed portions 17 are symmetry with respect to each other. Then, among the oblique surfaces 61, one of the oblique surfaces 61 is provided with the spout 4. The user can take up and tilt the plastic bag by hand easily, so as to discharge the content through the spout 4. The user can further drink a beverage, if the content is the beverage, from the spout 4.

As described above, in the plastic bag, the first folded portion 23 is superposed on the second folded portion 24, then the web of the second panel material 2 is folded back to the original state, and in the first folded portion 23, the web of the first panel material 1 is folded back along the folded back line 22*a*. The plastic bag made from the first and second panel materials 1 and 2 includes an end surface formed by the second folded portion 23 when being filled with the content. The end surface is, therefore, used as a bottom surface which can stand the plastic bag stably.

Second Embodiment

Figure 4A:
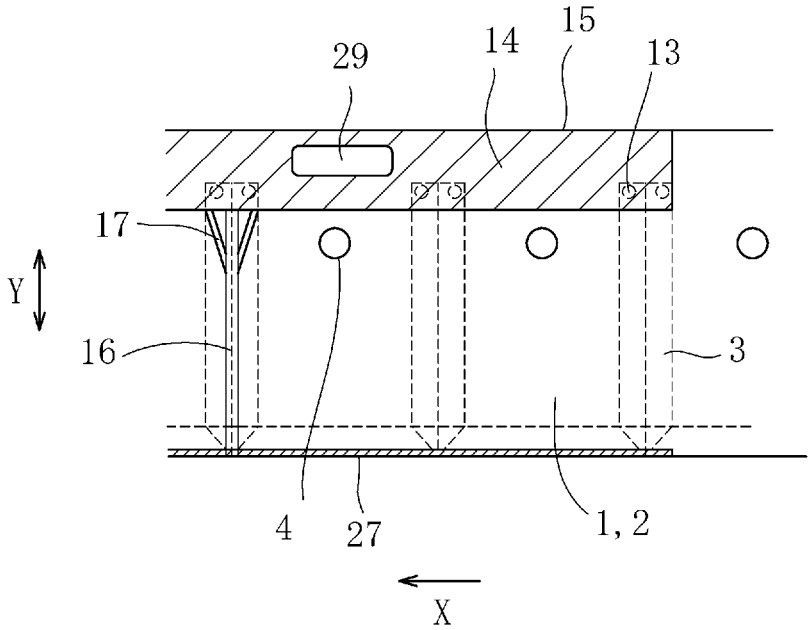
FIG. 4A is a plan view showing another embodiment.
Figure 4B:
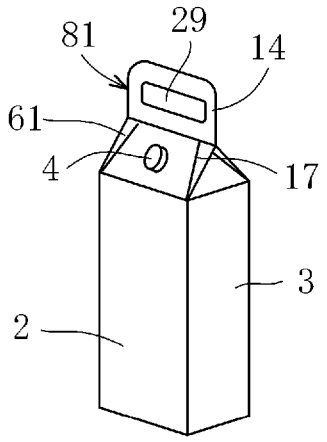
FIG. 4B is a perspective view showing the plastic bag made by the bag making machine shown in FIG. 4A.

FIG. 4A and FIG. 4B illustrate another embodiment. In the embodiment, the webs of the first and second panel materials 1 and 2 used in the bag making machine in FIG. 1A and FIG. 1B are large in the wide direction Y. The width of each of the webs of the first and second panel materials 1 and 2 is longer than the length of the side gusset material 3. That is, the length of the webs of the first and second panel materials 1 and 2 in the width direction Y is longer than the length of the side gusset material 3 in the width direction Y. Thus, The side gusset material 3 is not disposed between the webs of the first and second materials 1 and 2 at a position adjacent to the side edges 15. Moreover, the webs of the first and second panel materials 1 and 2 are heat sealed by the longitudinal seal device 11 so as to form the longitudinal sealed portion 14 having a predetermined width in the width direction Y. The longitudinal sealed portion 14 and the cross sealed portion 16 are connected to each other at a right angle. Then, a through portion 29 is formed in the longitudinal sealed portion 14 and between a pair of the cross sealed portions 16, so that a first handle 81 is formed by both the longitudinal sealed portion 14 and the through portion 29. Therefore, the user can hold and carry the plastic bag using the first handle 81. In other words, the first handle 81 includes the superposed first and second panel materials 1 and 2 (the longitudinal sealed portion 14). In the embodiment, the through portion 29 is an elongated hole extended in the longitudinal direction X.

A punching device may be provided by which the longitudinal sealed portion 14 is pressed to be punched in order to form the through portions 29, whenever the webs of the first and second panel materials 1 and 2 are fed intermittently in the manufacturing process of the plastic bags. A perforation forming blade may be provided by which the longitudinal sealed portion 14 is pressed so as to form perforations whenever the webs of the first and second panel materials 1 and 2 are fed intermittently in the manufacturing process of the plastic bags. Then, after the manufacture of the plastic bags, a part of the longitudinal sealed portion 14 can be cut out by the perforation in order to form the through portion 29.

Third Embodiment

Figure 5A:
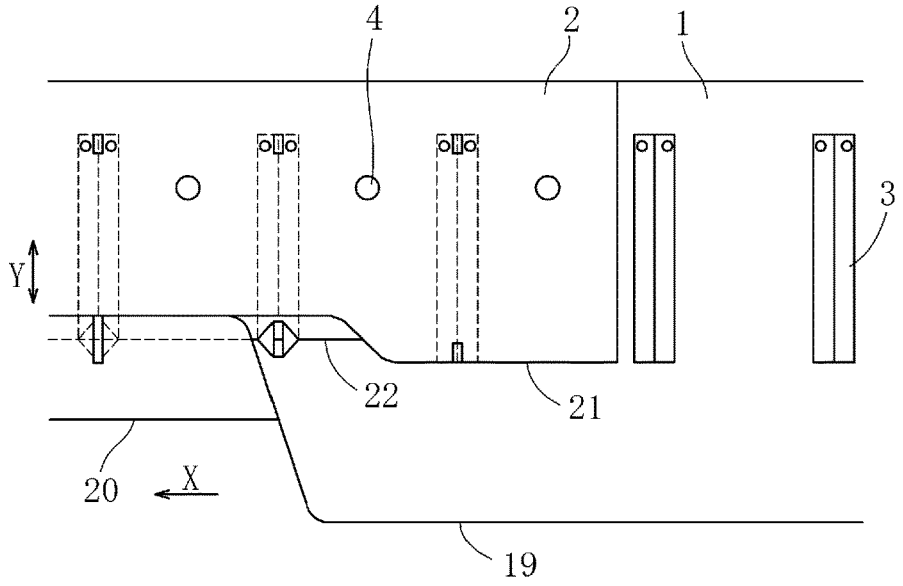
FIG. 5A is a plan view showing another embodiment.
Figure 5B:
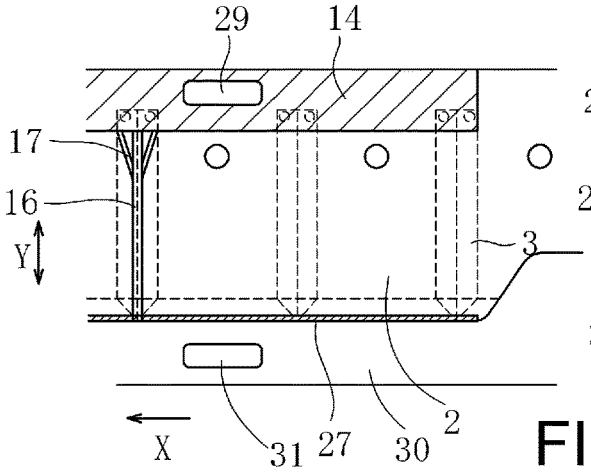
FIG. 5B is a plan view showing the side gusset materials in addition to the webs of the first and second panel materials in FIG. 5A when being heat sealed.
Figures 5F, 5G:
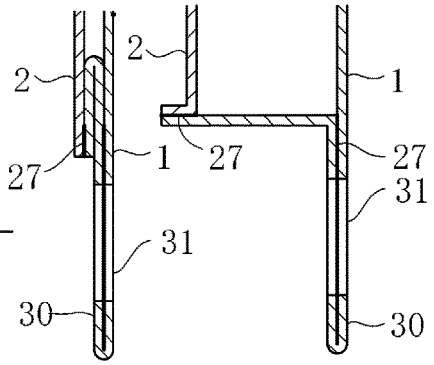
FIG. 5F is a sectional view showing the plastic bag in FIG. 5E wherein a plastic film thickness and heat sealed portions are exaggerated for convenience.
FIG. 5G is a sectional view showing the plastic bag in FIG. 5F before being filled with the content.
Figure 5C:
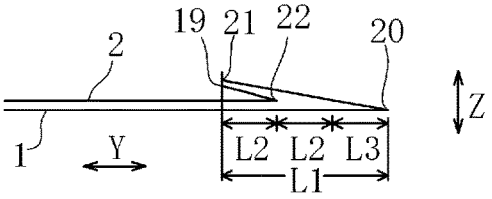
FIG. 5C is an explanatory view showing the webs of the first and second panel materials in FIG. 5A when being folded.

FIG. 5A to FIG. 5G illustrate another embodiment. In the embodiment of FIG. 4A and FIG. 4B, when the webs of the first and second panel materials 1 and 2 are folded along the first and second folded lines 20 and 22, the additional side edge 19 is apart from the first folded line 20 at a distance L1, while the corresponding additional side edge 21 is apart from the second folded line 22 at a distance L2. The distance L1 between the additional side edge 19 and the first folded line 20 in the width direction Y is longer than twice the distance L2 between the corresponding additional side edge 21 and the second folded line 22 by a predetermined distance L3 (FIG. 5C). Thus, a protruding portion 30 is formed by the predetermined distance L3, then a through portion 31 is formed in the protruding portion 30 so that a second handle 82 is formed by the protruding portion 30 and the through portion 31. In other words, the second handle 82 has a length of the predetermined distance L3 and includes the web of the first panel material 1 (the protruding portion 30) which is folded.

And, the additional side edge 19 protrudes beyond the corresponding additional side edge 21 by a predetermined distance L1' before the webs of the first and second panel materials 1 and 2 are folded. The distance L1' in the width direction Y is longer than twice the distance L2 between the corresponding additional side edge 21 and the second folded line 22 by twice the predetermined distance L3 (FIG. 5D). Then, the webs of the first and second panel materials 1 and 2 are folded. As a result, the distance L1 between the additional side edge 19 and the first folded line 20 in the width direction Y is longer than twice the distance L2 between the corresponding additional side edge 21 and the second folded line 22 by the predetermined distance L3, when the webs of the first and second panel materials 1 and 2 are folded.

Figure 5E:
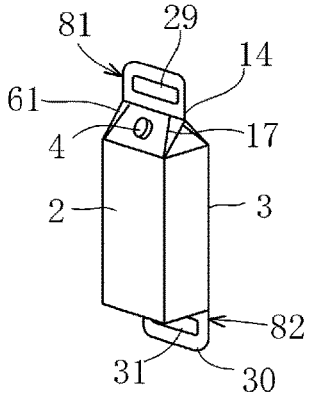
FIG. 5E is a perspective view showing the plastic bag made by the bag making machine in FIG. 5A.
Figure 5D:
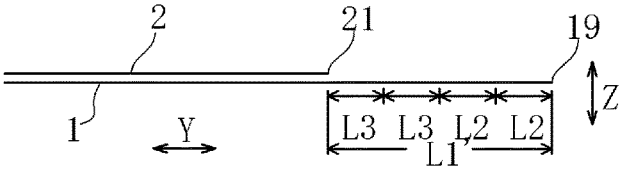
FIG. 5D is an explanatory view showing the webs of the first and second panel materials in FIG. 5A before being folded.

The plastic bag shown in FIG. 5A to FIG. 5G has the first and second handles 81 and 82. The first handle 81 is formed by the through portion 29, while the second handle 82 is formed by the through portion 31. In other words, the first handle 81 includes the webs of the first and second panel materials 1 and 2 (the longitudinal sealed portion 14) which are superposed. The second handle 82 has the length of the predetermined distance L3 and includes the webs of the first panel material 1 (the protruding portion 30) which are folded (FIGS. 5E to 5G). The user can therefore hold and carry the plastic bag with both hands. The user can also operate and tilt the plastic bag with both hands, so as to discharge the content through the spout 4.

The protruding portion 30, as in the case of the through portions 29, may be punched by the punching device in order to form the through portions 31 in the manufacturing process of the plastic bags. A part of the protruding portion 30 can be cut out by the perforation in order to form the through portion 31 after the manufacture of the plastic bags. Moreover, the webs of the first panel material 1 (the protruding portion 30) which are folded may be heat sealed, before or after forming the through portion 31.

Fourth Embodiment

Figure 6A:
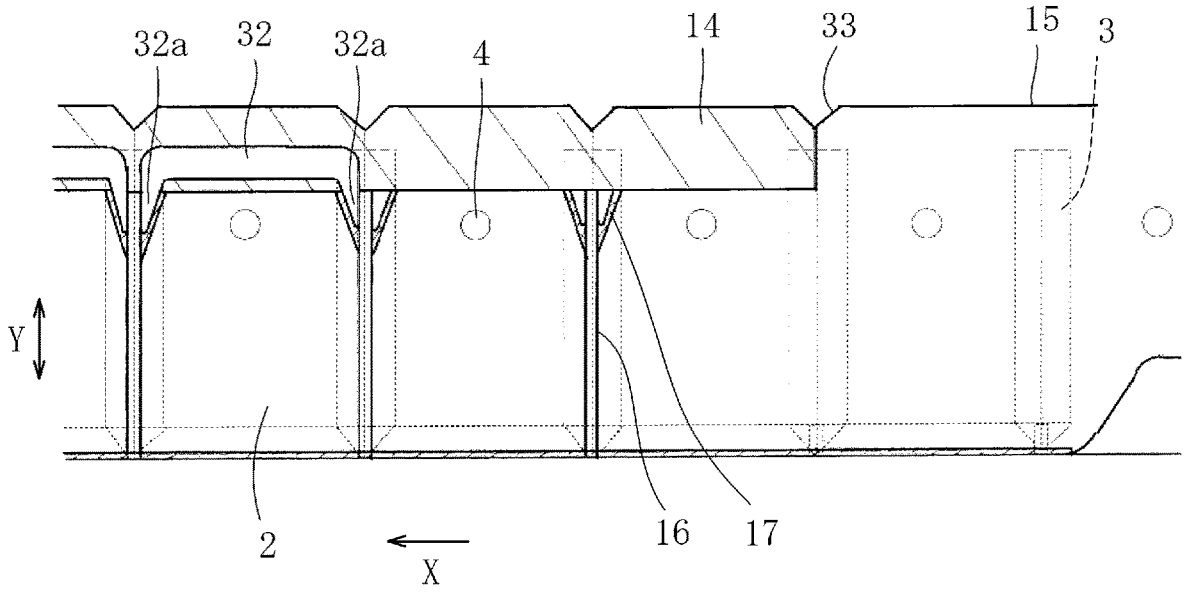
FIG. 6A is a plan view showing another embodiment.
Figure 6B:
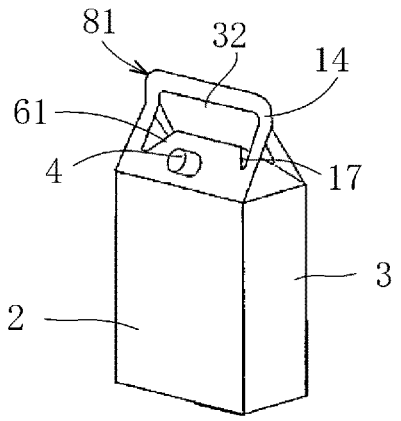
FIG. 6B is a perspective view showing the plastic bag made by the bag making machine in FIG. 6A.
Figure 6C:
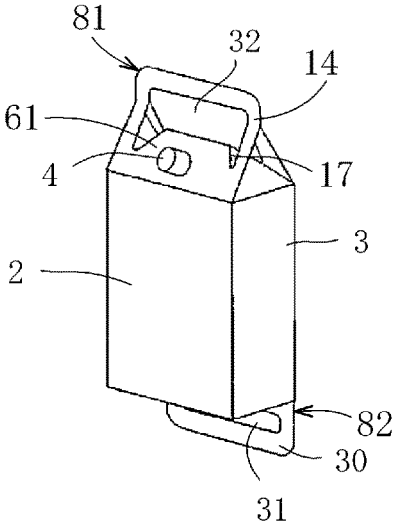
FIG. 6C is a perspective view showing another embodiment.

FIG. 6A to FIG. 6C illustrate another embodiment. In the embodiment, as shown in FIG. 6A to FIG. 6C, the plastic bag in FIG. 4A and FIG. 4B may have the through portion 32 which is extended along the oblique sealed portions 17 at opposite side portions of the through portion 32. That is, the through portion 32 is extended in the longitudinal direction X and includes a pair of oblique through portions 32*a* extended along the oblique sealed portions 17 at the opposite side portions of the through portion 32. The oblique through portions 32*a* can make the large through portion 32 and the oblique surfaces 61. Notches 33 can be formed on the longitudinal sealed portion 14 at the side edges 15 of the webs of the first and second panel materials 1 and 2. Each of the notches 33 is disposed on the centerline of the longitudinal direction (the width direction Y) of each of the side gusset materials 3 or the centerline if the longitudinal direction (the width direction Y) of each of the cross sealed portions 16.

In the case of the plastic bags in FIG. 6A to FIG. 6C, the first handle 81 is also formed by the longitudinal portion 14 and the through portion 32, however, the through portion 32 is extended along the oblique sealed portions 17. The through portion 32 includes the oblique through portions 32*a* extended along the oblique sealed portions 17 and at the opposite side portions of the through portion 32. The first handle 81 includes the webs of the first and second panel materials 1 and 2 (the longitudinal sealed portion 14) which are superposed. Thus, the plastic bag is therefore excellent in operability when being held and carried.

When making the plastic bags of FIG. 6A to FIG. 6C, at first, the notches 33 are formed in the webs of the first and second panel materials 1 and 2. Then, the webs of the first and second panel materials 1 and 2 are heat sealed with each other by the longitudinal seal device 11 so as to form the longitudinal sealed portion 14 (FIG. 6A). And then, the side gusset materials 3 in addition to the webs of the first and second panel materials 1 and 2 are heat sealed with each other by the cross seal device 12, so as to form the cross sealed portions 16 and the oblique sealed portions 17. The longitudinal sealed portion 14 and the cross sealed portion 16 are connected to each other at a right angle. The oblique sealed portions 17 are connected to the longitudinal sealed portion 14 and the cross sealed portion 16. Each of the oblique sealed portions 17 is oblique to the cross sealed portion 16 or the width direction Y at the predetermined angle α. A cutout blade, such as a Thomson blade is provided. And then, the longitudinal portion 14 is pressed and cutout by the cutout blade whenever the webs of the first and second panel materials 1 and 2 are fed intermittently. The cutout blade has a predetermined shape in order to form the through portion 32 extended along the oblique sealed portions 17. And then, the side gusset material 3 in addition to the webs of the first and second panel materials 1 and 2 may be cross cut by the cutter 28.

In the bag making machine of FIG. 6A to FIG. 6C, as in the case of the embodiment of FIG. 5A to FIG. 5G, the protruding portion 30 is formed by the predetermined distance L3, then the through portion 31 is formed in the protruding portion 30 so that the second handle 82 is made from the through portion 31 (FIG. 6C). The second handle 82 has a length of the predetermined distance L3 and includes the web of the first panel material 1 (the protruding portion 30) which is folded. The web of the first panel material 1 (the protruding portion 30) which is folded is heat sealed, before or after forming the through portion 31.

As described above, the distances L2 and L3 (FIG. 5C and FIG. 5D) of the webs of the first and second panel materials 1 and 2 can be determined, in order to adjust the depth size of the plastic bag and to change the size of the protruding portion 30 properly. The size of each of the through portions 29 and 32 (FIG. 5B and FIG. 6A) can be changed, in order to change the size of each of the handles. Specifically, the design of the handle of the plastic bag is deeply affected by whether the through portion 32 is provided with the oblique through portions 32*a* or not. According to the content of the plastic bag, the strength of the handle which is not provided with the oblique through portions 32*a* is important if the content is heavy, while the design of the handle which is provided with the oblique through portions 32*a* can be improved if the content is lightweight. Therefore, the plastic bag can have a lot of flexibility.

Fifth Embodiment

FIG. 7A to FIG. 7D illustrate another embodiment. The web of the first panel material 1 is a web of a panel material disposed on a lower side, while the web of the second panel material 2 is a web of a panel material disposed on an upper side, as in the case of the above bag making machine. Moreover, the webs of the first and second panel materials 1 and 2 are guided in the longitudinal direction X by the panel material guide device 18. A slit blade 18*a* is provided by which a web of the plastic film is slit and divided into two webs of the first and second panel materials 1 and 2. The web of the second panel material 2 can be guided to the upper side of the web of the first panel material 1 by the panel material guide device 18. For example, as shown in FIG. 8A to FIG. 8D, the panel material guide device 18 includes a plurality of bars or rollers 18*b* by which the web of the second panel material 2 is guided and turned over after the web of the plastic film is slit. The web of the second panel material 2 is guided to the upper side of the web of the first panel material 1. The webs of the first and second panel materials 1 and 2 are fed in the longitudinal direction X. A spout mounting device 8 is provided in order to form apertures 1*a*. Further, the spouts 4 are inserted into and positioned with the apertures 1*a* by the spout mounting device 8, as in the case of the bag making machine of FIG. 1A and FIG. 1B. In the case of the apparatus of FIG. 7A to FIG. 7D, the aperture 1*a* is formed in not the web of the second panel material 2 disposed at the upper side, but the web of the first panel material 1 disposed at the lower side, so that the spouts 4 are inserted into and positioned with the apertures 1*a*.

Moreover, the side gusset materials 3 are disposed between the webs of the first and second panel materials 1 and 2, as in the case of the bag making machine of FIG. 7A to FIG. 7D. The web of the first panel material 1 includes a side edge 34. The web of the second panel material 2 includes a corresponding side edge 36. In the embodiment of FIG. 7A to FIG. 7D, the webs of the first and second panel materials 1 and 2 are guided by the panel material guide device 18, while the webs of the first and second panel materials 1 and 2 are fed. The web of the first panel material 1 is folded along a first folded line 35 at a position adjacent to the side edge 34, while the web of the second panel material 2 is folded along a second folded line 37 at a position adjacent to the corresponding side edge 36. Thus, a first folded portion 38 is formed on the web of the first panel material 1, while a second folded portion 39 is formed on the web of the second panel material 2. The spout 4 is turned over by the web of the first panel material 1 when being folded. The first folded portion 38 is superposed on the second folded portion 39 so that the side edge 34 is aligned with the corresponding side edge 36.

Figure 7A:
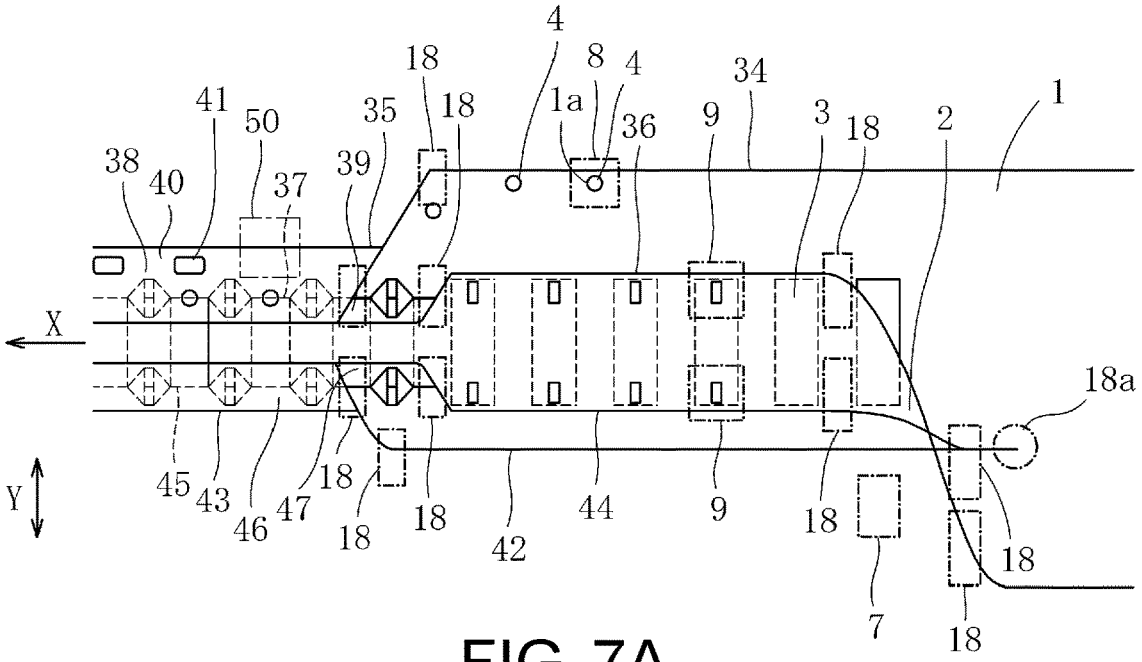
FIG. 7A is a plan view showing another embodiment.
Figure 7B:
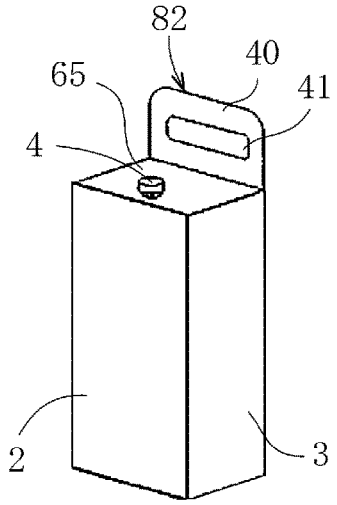
FIG. 7B is a perspective view showing the plastic bag made by the bag making machine in FIG. 7A.
Figure 7C:
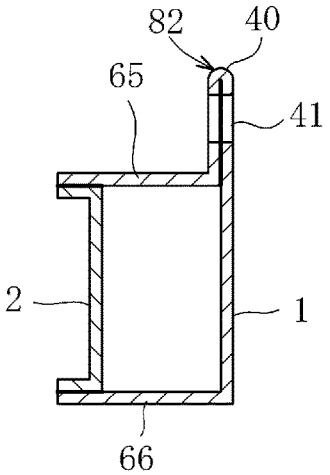
FIG. 7C is a sectional view showing the plastic bag in FIG. 7B wherein a plastic film thickness and heat sealed portions are exaggerated for convenience.
Figure 7D:
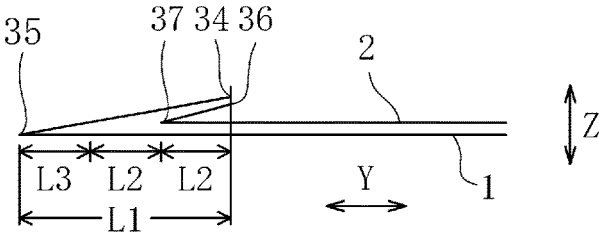
FIG. 7D is an explanatory view showing the webs of the first and second panel materials in FIG. 7A when being folded.
Figure 8C:
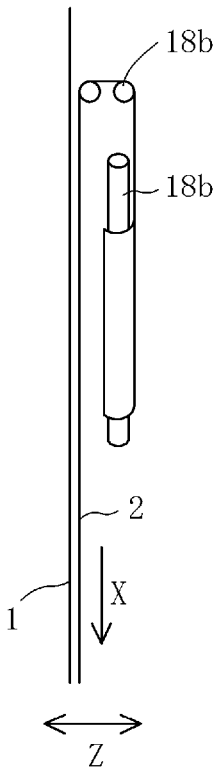
FIG. 8C is a left side view showing the web of the second panel material in FIG. 8A.
Figure 8A:
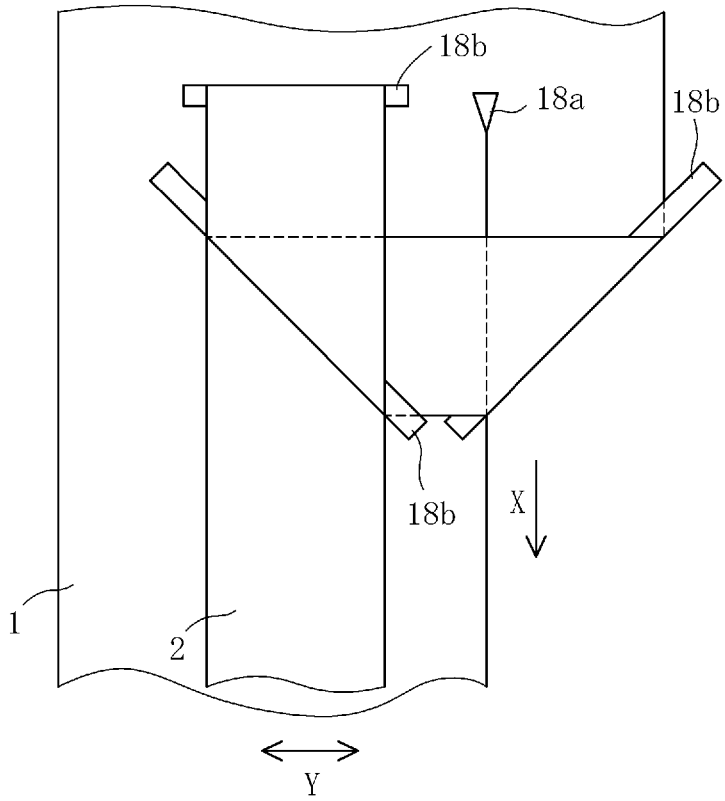
FIG. 8A is a plan view showing the web of the second panel material in FIG. 7A to FIG. 7D when being guided.
Figure 8B:
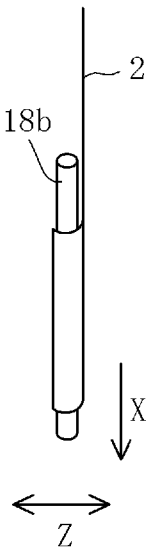
FIG. 8B is a right side view showing the web of the second panel material in FIG. 8A.
Figure 8D:
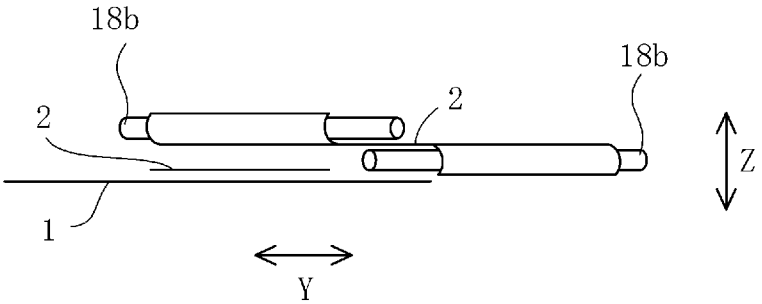
FIG. 8D is a front view showing the web of the second panel material in FIG. 8A.

In the bag making machine of FIG. 7A to FIG. 7D, when the webs of the first and second panel materials 1 and 2 are folded along the first and second folded lines 35 and 37, the side edge 34 is apart from the first folded line 35 at a distance L1, and the corresponding side edge 36 being apart from the second folded line 37 at a distance L2. The distance L1 between the side edge 34 and the first folded line 35 in the width direction Y is longer than twice the distance L2 between the corresponding side edge 36 and the second folded line 37 by a predetermined distance L3 (FIG. 7D). Thus, the plastic bag is made from the webs of the first and second panel materials 1 and 2, as in the case of the bag making machine of FIG. 1A and FIG. 1B. However, in the bag making machine of FIG. 7A to FIG. 7D, an end surface 65 is formed by the first folded portion 38 and provided with the spout 4. The end surface 65 is connected to the webs of the first and second panel materials 1 and 2 at a right angle. A protruding portion 40 is, as in the case of the bag making machine of FIG. 5A to FIG. 5G, formed by the predetermined distance L3, then a through portion 41 is formed in the protruding portion 40 so that the second handle 82 is made from the protruding portion 40 and the through portion 41. The protruding portion 40 is extended in the longitudinal direction X. The second handle 82 has a length of the predetermined distance L3 and includes the web of the first panel material 1 (the protruding portion 30) which is folded.

The web of the first panel material 1 (the protruding portion 40) which is folded is heat sealed, before or after forming the through portion 41.

Moreover, the web of the first panel material 1 includes an additional side edge 42. The web of the second panel material 2 includes a corresponding additional side edge 44. In the bag making machine of FIG. 7A to FIG. 7D, the webs of the first and second panel materials 1 and 2 are guided by the panel material guide device 18. The web of the first panel material 1 is folded along a third folded line 43 at a positon adjacent to the additional side edge 42, while the web of the second panel material 2 is folded along a fourth folded line 45 at a position adjacent to the corresponding additional side edge 44. As a result, a third folded portion 46 is formed on the web of the first panel material 1, while a fourth folded portion 47 is formed on the web of the second panel material 2. Further, the third folded portion 46 is superposed on the fourth folded portion 47, so that the additional side edge 42 is aligned with the corresponding additional side edge 44. Thus, an additional end surface 66 is formed by the third folded portion 46. The additional end surface 66 is connected to the webs of the first and second panel materials 1 and 2 at a right angle.

Sixth Embodiment

Figure 9A:
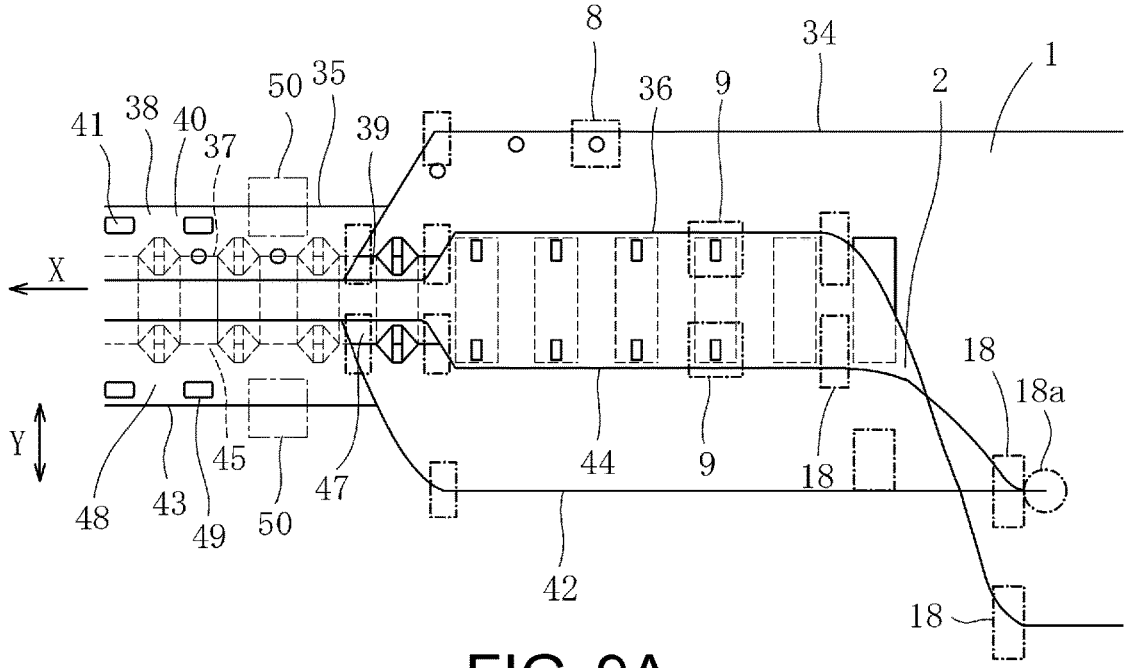
FIG. 9A is a plan view showing another embodiment.
Figure 9B:
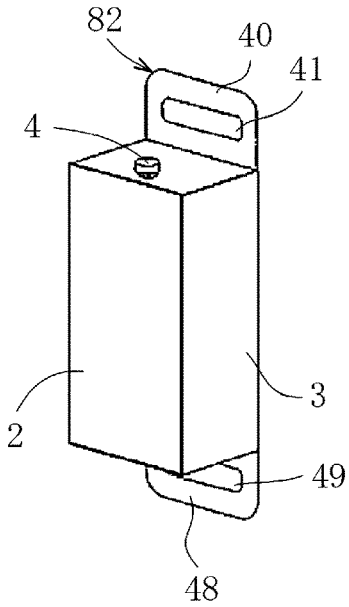
FIG. 9B is a perspective view showing the plastic bag made by the bag making machine in FIG. 9A.
Figure 9C:
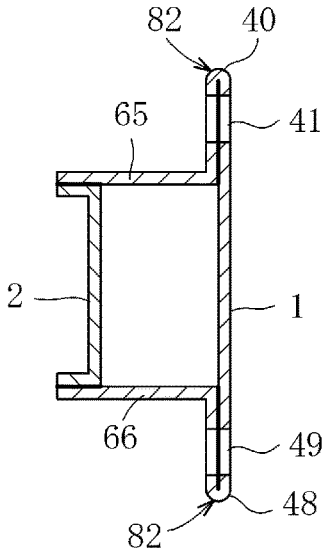
FIG. 9C is a sectional view showing the plastic bag in FIG. 9B wherein a plastic film thickness and heat sealed portions are exaggerated for convenience.
Figure 9D:
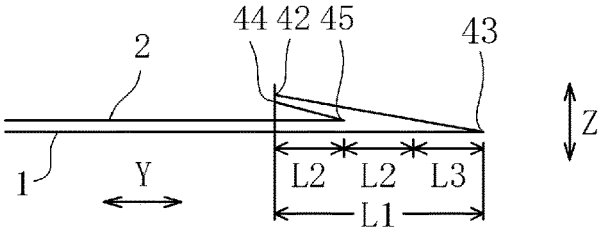
FIG. 9D is an explanatory view showing the webs of the first and second panel materials in FIG. 9A when being folded.

FIG. 9A to FIG. 9D illustrate another embodiment. When the webs of the first and second panel materials 1 and 2 are folded along the third and fourth folded lines 43 and 45 by the bag making machine of FIG. 7A to FIG. 7D, as in the case of the bag making machine of FIG. 5A to FIG. 5G, the additional side edge 42 is apart from the third folded line 43 at a distance L1, while the corresponding additional side edge 44 being apart from the fourth folded line 45 at a distance L2. The distance L1 between the additional side edge 42 and the third folded line 43 in the width direction Y is longer than twice the distance L2 between the corresponding additional side edge 44 and the fourth folded line 45 by a predetermined distance L3 (FIG. 9D). Thus, a protruding portion 48 is formed by the predetermined distance L3, then a through portion 49 is formed in the protruding portion 48 so that the second handle 82 is made from the protruding portion 48 and the through portion 49. For example, a punching device or a perforation forming blade 50 is provided by which the through portion 41 and through portion 49 are formed. The protruding portion 48 is extended in the longitudinal direction X to be parallel and opposite to the protruding portion 40. That is, the second handle 82 has a length of the predetermined distance L3 and includes the web of the first panel material 1 (the protruding portion 48) which is folded. And, the web of the first panel material 1 (the protruding portion 48) which is folded is heat sealed, before or after forming the through portion 49.

In the embodiment, the two second handles 82 are formed. One of the two second handles 82 has a length of the predetermined distance L3 and includes the web of the first panel material 1 (the protruding portion 40) which is folded, and the other of the two second handles 82 has a length of the predetermined distance L3 and includes the web of the first panel material 1 (the protruding portion 48) which is folded.

Seventh Embodiment

Figure 10A:
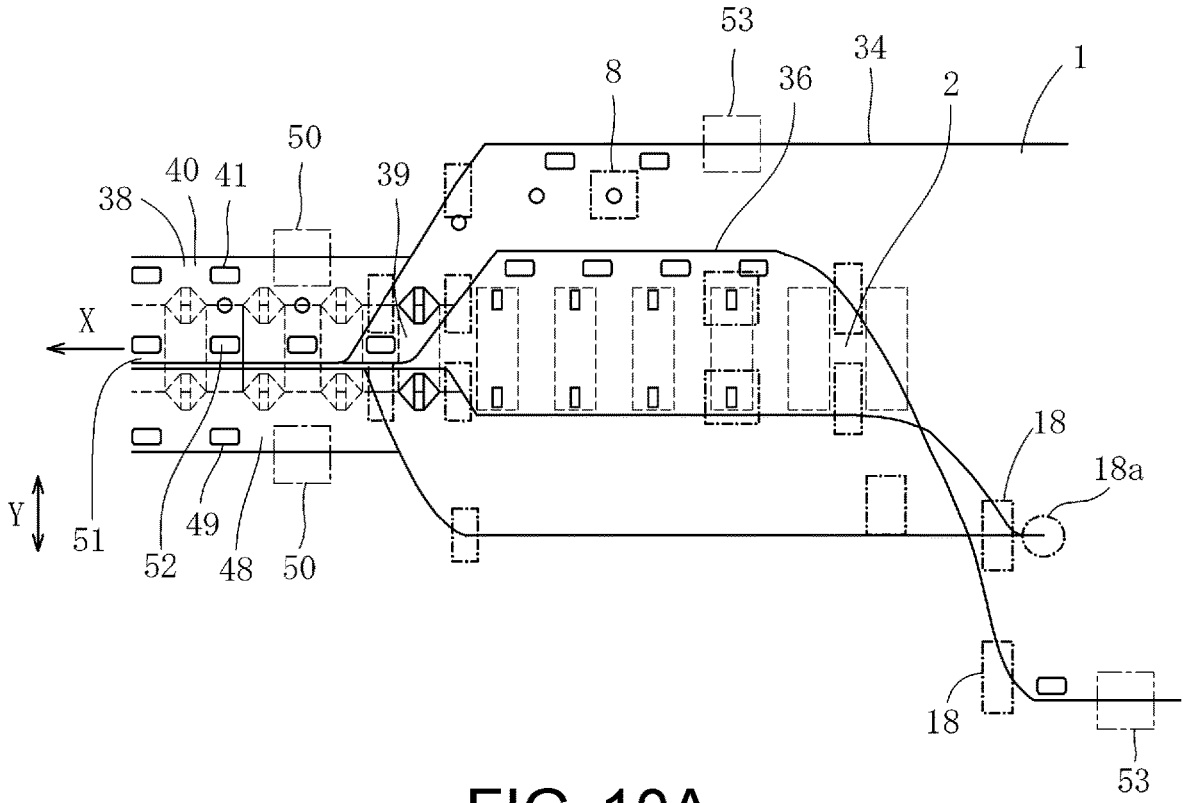
FIG. 10A is a plan view showing another embodiment.
Figure 10B:
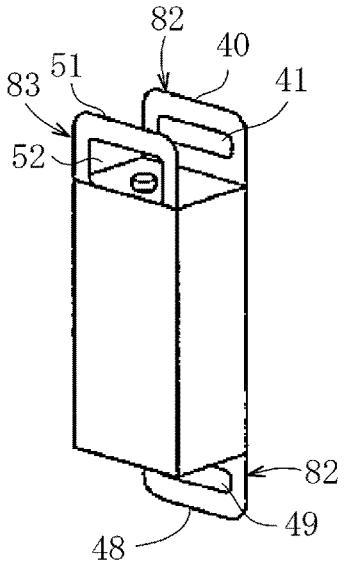
FIG. 10B is a perspective view showing the plastic bag made by the bag making machine in FIG. 10A.
Figure 10C:
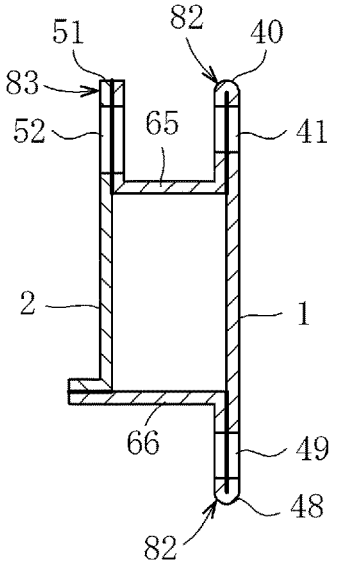
FIG. 10C is a sectional view showing the plastic bag in FIG. 10B wherein a plastic film thickness and heat sealed portions are exaggerated for convenience.

FIG. 10A to FIG. 10C illustrate another embodiment. The first and second folded portions 38 and 39 are formed on the webs of the first and second panel materials 1 and 2 by the bag making machines of FIG. 7A to FIG. 7D and FIG. 9A to FIG. 9D. However, as shown in FIG. 10A to FIG. 10C, the webs of the first and second panel materials 1 and 2 are further longer in the width direction Y. Each of the first and second folded portions 38 and 39 may have an extra width in the width direction Y, when the first and second folded portions 38 and 39 are formed. Further, an extra portion 51 is formed by the extra width in the width direction Y, then a through portion 52 is formed in the extra portion 51, so that a third handle 83 is made from the extra portion 51 and the through portion 52. The extra portion 51 is extended in the longitudinal direction X to be parallel and opposite to the protruding portion 40. For example, a punching device 53 is provided in order to form the through portions 52 before the webs of the first and second panel materials 1 and 2 are superposed on each other. Thus, the third handle 83 includes the first and second panel materials 1 and 2 (the extra portion 51) which are superposed. The first and second panel materials 1 and 2 (the extra portion 51) which are superposed are heat sealed, before or after forming the through portion 52.

The protruding portion 40 is formed by the predetermined distance L3, so that the second handle 82 is made from the protruding portion 40 and the through portion 41, as in the case of the embodiments of FIG. 7A to FIG. 7D and FIG. 9A to FIG. 9D. In this case, the end surface 65 is formed by the first folded portion 38. The protruding portion 40 is formed at one side of the end surface 65, and the second handle 82 is formed, while the extra portion 51 is formed at the other side of the end surface 65, and the third handle 83 is formed. The first and second folded portions 38 and 39 are heat sealed respectively along the side edge 34 and the corresponding side edge 36 of the webs of the first and second panel materials 1 and 2, as in the case of the above embodiments.

In the embodiment, the two second handles 82 are formed. One of the two second handles 82 has a length of the predetermined distance L3 and includes the web of the first panel material 1 (the protruding portion 40) which is folded, and the other of the two second handles 82 has a length of the predetermined distance L3 and includes the web of the first panel material 1 (the protruding portion 48) which is folded.

Eighth Embodiment

Figure 11A:
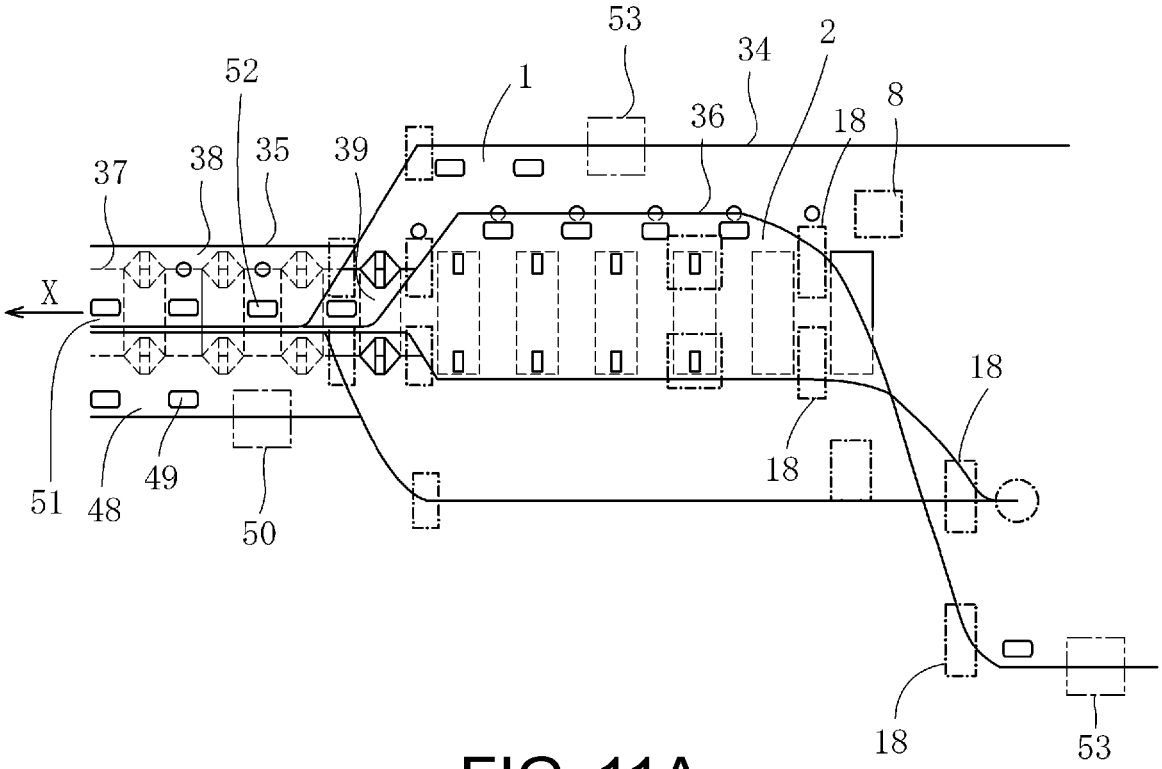
FIG. 11A is a plan view showing another embodiment.
Figure 11B:
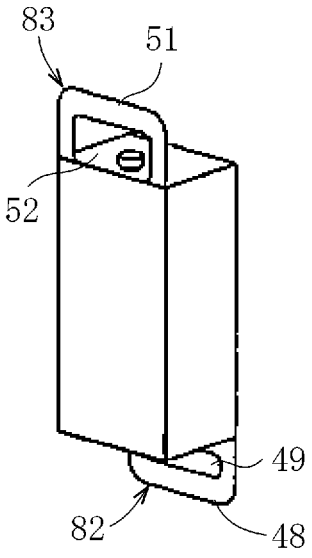
FIG. 11B is a perspective view showing the plastic bag made by the bag making machine in FIG. 11A.
Figure 11C:
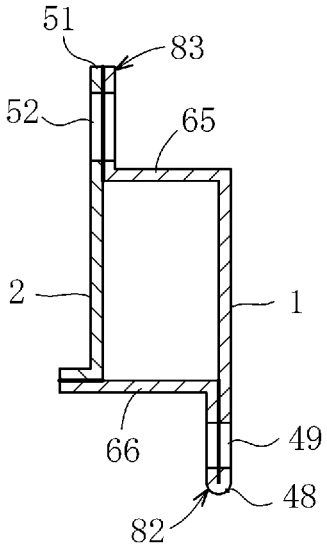
FIG. 11C is a sectional view showing the plastic bag in FIG. 11B wherein a plastic film thickness and heat sealed portions are exaggerated for convenience.

FIG. 11A to FIG. 11C illustrate another embodiment. As shown in FIG. 11A to FIG. 11C, the extra portion 51 is formed by the extra width, then the through portion 52 is formed in the extra portion 51. However, the protruding portion 40 may be not formed.

Ninth Embodiment

Figure 12A:
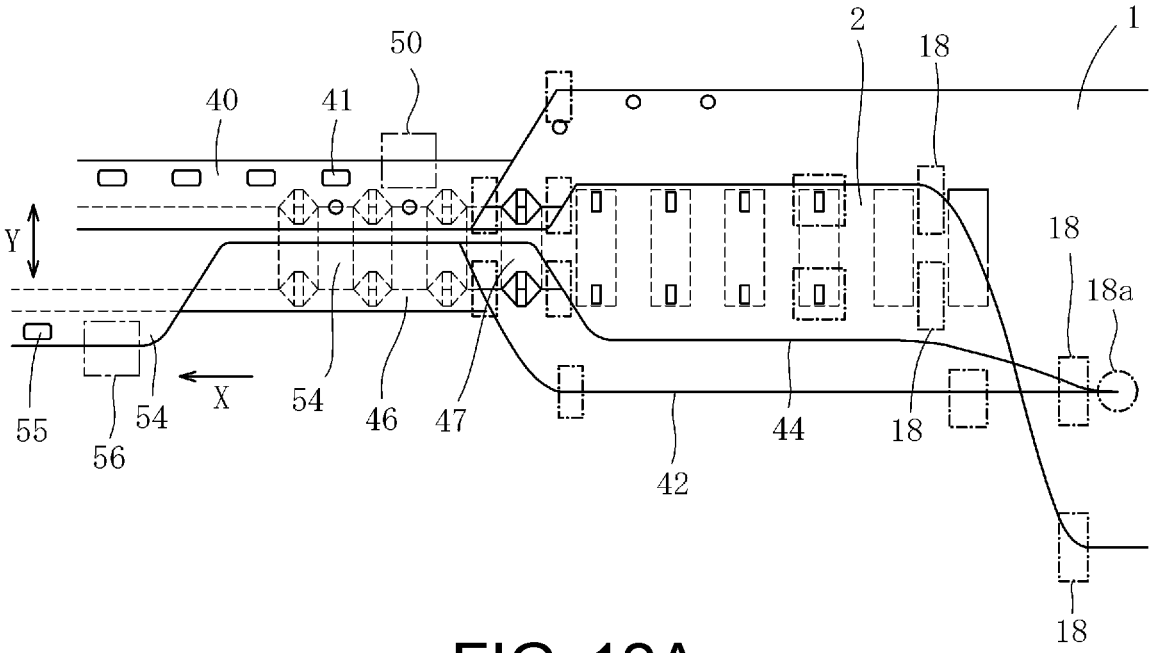
FIG. 12A is a plan view showing another embodiment.
Figure 12B:
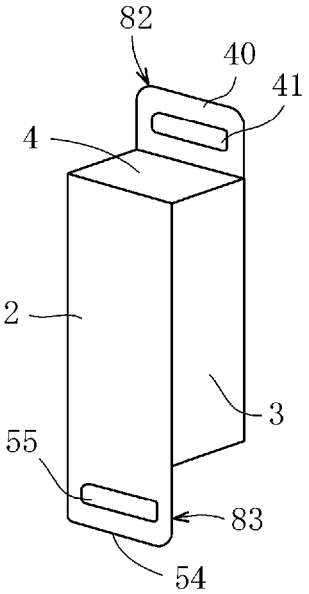
FIG. 12B is a perspective view showing the plastic bag made by the bag making machine in FIG. 12A.
Figure 12C:
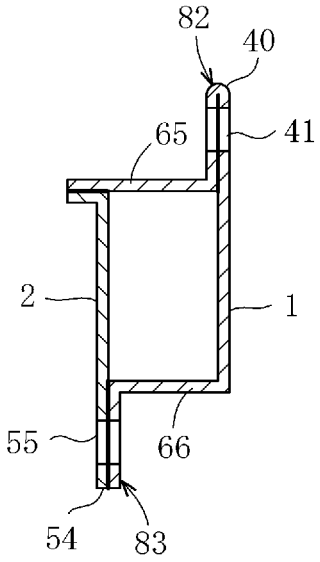
FIG. 12C is a sectional view showing the plastic bag in FIG. 12B wherein a plastic film thickness and heat sealed portions are exaggerated for convenience.

FIG. 12A to FIG. 12C illustrate another embodiment. The protruding portion 40 is formed by the predetermined distance L3, then the through portion 41 is formed in the protruding portion 40, as in the case of the embodiments of FIG. 7A to FIG. 7D and FIG. 9A to FIG. 9D. In the embodiment in FIG. 12A to FIG. 12C, each of the third and fourth folded portions 46 and 47 may further have the extra width in the width direction Y. An extra portion 54 is formed by the extra width in the width direction Y, then a through portion 55 is formed in the extra portion 54, so that the third handle 83 is made from the extra portion 54 and the through portion 55. The extra portion 54 is extended in the longitudinal direction X to be parallel and opposite to the protruding portion 40.

In the embodiment of FIG. 12A to FIG. 12C, a punching device 56 is provided by which the through portion 55 is formed, after the webs of the first and second panel materials 1 and 2 are unfolded and folded back.

A combination of the protruding portions 40 and 48, the extra portions 51 and 54, the second and third handles 82 and 83 are not limited to the embodiments, so as to be modified properly depending on the purpose of the plastic bag.

What is claimed is:

1. A bag making machine, comprising:

a panel material feed device, by which webs of a first panel material and a second panel material are superposed on each other, and fed in a longitudinal direction of the webs of the first panel material and the second panel material intermittently;

a side gusset material supply device, by which side gusset materials are supplied to the web of the first panel material or the web of the second panel material, so as to be extended in a width direction of the webs of the first panel material and the second panel material, whenever the webs of the first panel material and the second panel material are fed intermittently before the webs of the first panel material and the second panel material are superposed on each other, the side gusset materials being disposed between the webs of the first panel material and the second panel material when the webs of the first panel material and the second panel material are superposed on each other;

a spout mounting device, by which an aperture is formed in the web of the first panel material or the web of the second panel material, and a spout is inserted into and positioned with the aperture, whenever the webs of the first panel material and the second panel material are fed intermittently before the webs of the first panel material and the second panel material are superposed on each other;

a longitudinal seal device, by which the webs of the first panel material and the second panel material are heat sealed with each other in the longitudinal direction of the webs of the first panel material and the second panel material, whenever the webs of the first panel material and the second panel material are fed intermittently after the webs of the first panel material and the second panel material are superposed on each other;

a cross seal device, by which the webs of the first panel material and the second panel material are heat sealed with the side gusset materials in the width direction of the webs of the first panel material and the second panel material so as to form cross sealed portions, whenever the webs of the first panel material and the second panel material are fed intermittently after the webs of the first panel material and second panel material are superposed on each other;

an oblique seal device, by which the webs of the first panel material and the second panel material are obliquely heat sealed with the side gusset materials at a position adjacent to a longitudinal sealed portion of side edges of the webs of the first panel material and the second panel material so as to form oblique sealed portions, the longitudinal sealed portion and the cross sealed portions being connected to each other by the oblique sealed portions;

a first cutout blade, by which the longitudinal sealed portion is cut out between each of the cross sealed portions so as to form a first through portion, the longitudinal sealed portion of the side edges of the webs of the first panel material and the second panel material having a predetermined width in the width direction;

a panel material guide device, by which the webs of the first panel material and the second panel material are guided while the webs of the first panel material and the second panel material are fed, the web of the first panel material including an additional side edge, the web of the second panel material including a corresponding additional side edge, the web of the first panel material being folded at a position adjacent to the additional side edge and along a first folded line, the web of the second panel material being folded at a position adjacent to the corresponding additional side edge and along a second folded line, whereby a first folded portion being formed on the web of the first panel material, a second folded portion being formed on the web of the second panel material, then the first folded portion being superposed on the second folded portion, and the additional side edge being aligned with the corresponding additional side edge, furthermore, when the webs of the first panel material and the second panel material are folded along the first folded line and the second folded line, the additional side edge being apart from the first folded line at a distance L1, the corresponding additional side edge being apart from the second folded line at a distance L2, the distance L1 between the additional side edge and the first folded line being longer than twice the distance L2 between the corresponding additional side edge and the second folded line by a predetermined distance L3, a protruding portion being formed by the predetermined distance L3;

a second cutout blade, by which the protruding portion is cut out so as to form a second through portion; and a cutter, by which the side gusset materials in addition to the webs of the first panel material and the second panel material are cross cut in the width direction of the webs of the first panel material and the second panel material, whenever the webs of the first panel material and the second panel material are fed intermittently after being heat sealed;

wherein the web of the first panel material or the web of the second panel material is provided with the spout, and a plastic bag being made from the side gusset materials in addition to the webs of the first panel material and the second panel material;

a first handle is made from both the longitudinal sealed portion and the first through portion;

an end surface is formed by the first folded portion;

a second handle is made from both the protruding portion and the second through portion;

the side gusset materials in addition to the webs of the first panel material and the second panel material are bonded with each other by the oblique sealed portions at a position adjacent to the longitudinal sealed portion, so that oblique surfaces are formed on the webs of the first panel material and the second panel material respectively, when the plastic bag being filled with a content, and among the oblique surfaces, one of the oblique surfaces being provided with the spout.

2. The bag making machine as set forth in claim 1, further comprising:

guide rollers, configured to guide the web of the first panel material or the web of the second panel material to which the spout is mounted by the spout mounting device, wherein the guide rollers are divided widthwise of the web of the first panel material or the web of the second panel material at an interval through which the spout is passed.

3. The bag making machine as set forth in claim 1, further comprising:

a guide roller, configured to guide the web of the first panel material or the web of the second panel material to which the spout is mounted by the spout mounting device, wherein the guide roller comprises a reduced diameter in such a manner that a diameter of the guide roller is reduced partially, and the spout is passed through the reduced diameter.

4. A method for making the plastic bag, comprising:

using the bag making machine as set forth in claim 1.

* * * * *